US010994183B1

(12) United States Patent
Lee

(10) Patent No.: US 10,994,183 B1
(45) Date of Patent: May 4, 2021

(54) GOLF SWING TRAINING DEVICE AND METHOD OF USE

(71) Applicant: James Lee, Indianapolis, IN (US)

(72) Inventor: James Lee, Indianapolis, IN (US)

( * ) Notice: Subject to any disclaimer, the term of this patent is extended or adjusted under 35 U.S.C. 154(b) by 0 days.

(21) Appl. No.: 17/088,678

(22) Filed: Nov. 4, 2020

Related U.S. Application Data

(60) Provisional application No. 62/930,819, filed on Nov. 5, 2019.

(51) Int. Cl.
*A63B 69/36* (2006.01)
*A63B 21/00* (2006.01)
*A63B 15/00* (2006.01)

(52) U.S. Cl.
CPC ..... *A63B 69/3632* (2013.01); *A63B 15/00* (2013.01); *A63B 21/4005* (2015.10)

(58) Field of Classification Search
CPC .. A63B 69/3632; A63B 21/4005; A63B 15/00
USPC ..... 473/201, 204, 212, 218, 219, 227, 276, 473/277, 294, 299, 409
See application file for complete search history.

(56) References Cited

U.S. PATENT DOCUMENTS 5,342,055 A * 8/1994 Diley ..... A63B 69/36213 473/208
5,520,392 A * 5/1996 Foresi ..... A63B 69/0059 473/227
D493,503 S * 7/2004 Rohan-Weaver ..... D21/791
7,244,187 B2 * 7/2007 Brooks ..... A63B 69/0057 473/226
7,789,765 B2 * 9/2010 Marini ..... A63B 69/3608 473/226
2002/0094879 A1 * 7/2002 Dawson ..... A63B 60/34 473/219
2004/0198526 A1 * 10/2004 Rohan-Weaver ..... A63B 60/10 473/219
2005/0049061 A1 * 3/2005 Skelley ..... A63B 69/3632 473/219
2006/0035716 A1 * 2/2006 Brooks ..... A63B 69/0057 473/227
2006/0122000 A1 * 6/2006 Paredes ..... A63B 69/3638 473/219
2008/0293508 A1 * 11/2008 Novosel, Sr. ..... A63B 69/3632 473/238

* cited by examiner

*Primary Examiner* — Nini F Legesse
(74) *Attorney, Agent, or Firm* — Boudwin Intellectual Property; Daniel Boudwin

(57) ABSTRACT

A golf swing training device and method of use is provided. The golf swing training device has an elongated member with a first end disposed opposite a second end. The first end includes a slot which is sized to receive a shaft of a golf club. The slot is disposed at a diagonal angle relative to the elongated member such that the shaft of the golf club passes through the elongated member. A curled member is disposed at the second end which can wrap around a shoulder of a user. In use, the golf training aid provides tactile feedback to a user as they execute a golf swing and aids in training the user to keep their arms in a proper position throughout a backswing and a golf swing motion.

11 Claims, 9 Drawing Sheets

GOLF SWING TRAINING DEVICE AND METHOD OF USE

CROSS REFERENCE TO RELATED APPLICATIONS

This application claims the benefit of U.S. Provisional Application No. 62/930,819 filed on Nov. 5, 2019. The above identified patent application is herein incorporated by reference in its entirety to provide continuity of disclosure.

BACKGROUND OF THE INVENTION

The present invention relates to golf training aids. More particularly, the present invention provides for a golf swing training device and method of use to train an individual in the proper mechanics and arm positioning employed during a golf backswing and through a golf swing.

Many people spend countless hours on the golf course, driving range, and chipping green trying to master the proper body mechanics employed during a golf swing. The learning curve for such an endeavor can be quite steep, and bad habits can creep into the individual player's swing which can be hard to correct. In particular, many golfers practice the mechanics of a golf swing, but have difficulty keeping their arm straight as they execute from the bottom to the top of the swing. A proper golf swing entails a golfer not only keeping their arm straight throughout the swing, but also shifting their hips instead of sliding them, and keeping their head aligned in a proper posture at the top of the backswing. When sound mechanics are utilized, the golfer's core is strengthened, and the golfer can develop muscle memory for the proper mechanics. In addition, it can be difficult to master the correct posture needed for a desired swing. Some people hire personal trainers to teach them the finer points of the game and work with the individual golfer on the golfer's stance and golf swings. Such trainers are expensive and are not always available when the golfer desires or has time to practice. Golfers are always looking for new tools to help them perfect their swing, especially a device that they can use on their own when they have free time.

The present invention substantially diverges in design elements from the known art and consequently it is clear that there is a need in the art for an improvement to existing golf training aids. In this regard the present invention substantially fulfills these needs.

SUMMARY OF THE INVENTION

In view of the foregoing disadvantages inherent in the known types of golf training aids now present in the prior art, the present invention provides a golf swing training device and method of use to train an individual in the proper mechanics and arm positioning employed during a golf backswing and through a golf swing. The present golf swing training device comprises an elongated member with a first end disposed opposite a second end. The first end includes a slot which is sized to receive a shaft of a golf club. The slot is disposed at a diagonal angle relative to the elongated member such that the shaft of the golf club passes through the elongated member. A curled member is disposed at the second end which can wrap around a shoulder of a user. In use, the golf training aid provides tactile feedback to a user as they execute a golf swing and aids in training the user to keep their arms in a proper position throughout a backswing and a golf swing motion.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
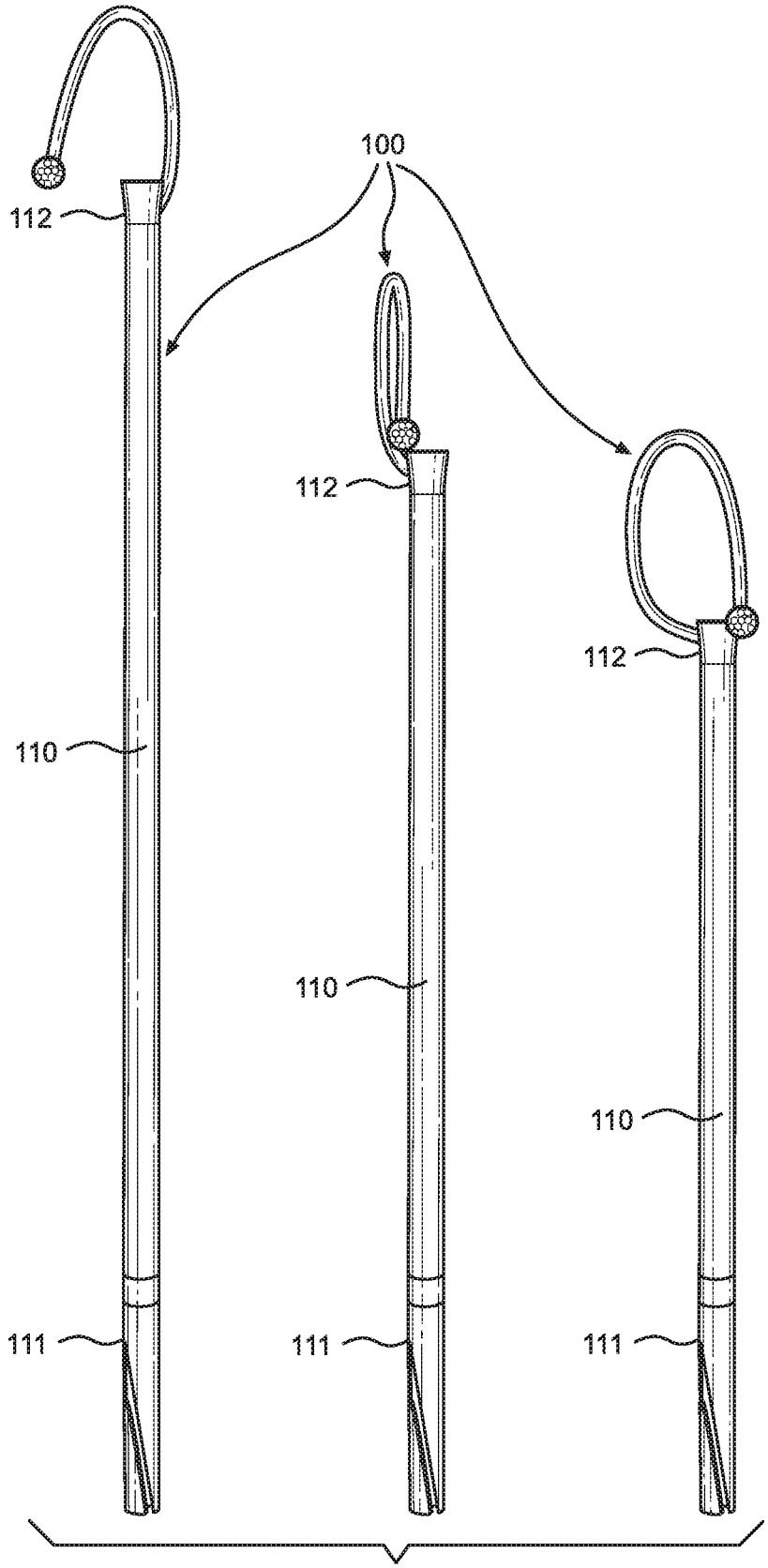
FIG. 1 shows a side view of multiple embodiments of the golf swing training device.

Reference is made herein to the attached drawings. Like reference numerals are used throughout the drawings to depict like or similar elements of the golf swing training device. For the purposes of presenting a brief and clear description of the present invention, a preferred embodiment will be discussed as used for the golf swing training device. The figures are intended for representative purposes only and should not be considered to be limiting in any respect.

Referring now to FIG. 1, there is shown a side view of multiple embodiments of the golf swing training device. The golf swing training device 100 comprises an elongated member 110 with a first end 111 disposed opposite a second end 112. In the shown embodiment, the elongated member 110 is composed of polyvinyl chloride (PVC) which provides strength and durability, as well as a minimal degree of flexibility, to the elongated member 110. Such strength and durability are desired as the present device is intended to be portable and used in a wide variety of environments ranging from indoors to outside. As the device can be used outside, in poor weather conditions such as those that may be experienced on a golf course, the elongated member 110 is configured to withstand inclement weather such as heavy rain. Additionally, the minimal degree of flexibility is desired as the device is intended to be used as a tactile guide for a golfer working to improve their golf swing.

Although materials with substantial flexibility are contemplated by the present invention, they may not provide a needed level of stiffness to reinforce the desired mechanics of a golf swing. For example, if the elongated member 110 was easily bent, or was not stiff enough to maintain a straight configuration, the elongated member 110 would not be as effective at providing a tactile guide to the user's arm as the user progressed through the golf swing. In one embodiment, the elongated member 110 has a one-inch diameter to provide a noticeable guide without inhibiting the mechanics of the golf swing or being overly burdensome or cumbersome to the user while in use. The elongated member 110 is intended to be held between the user's body and arm, and it is therefore contemplated that the diameter of the elongated member 110 does not unduly hinder the mechanics of the golf swing when in use.

Figure 2:
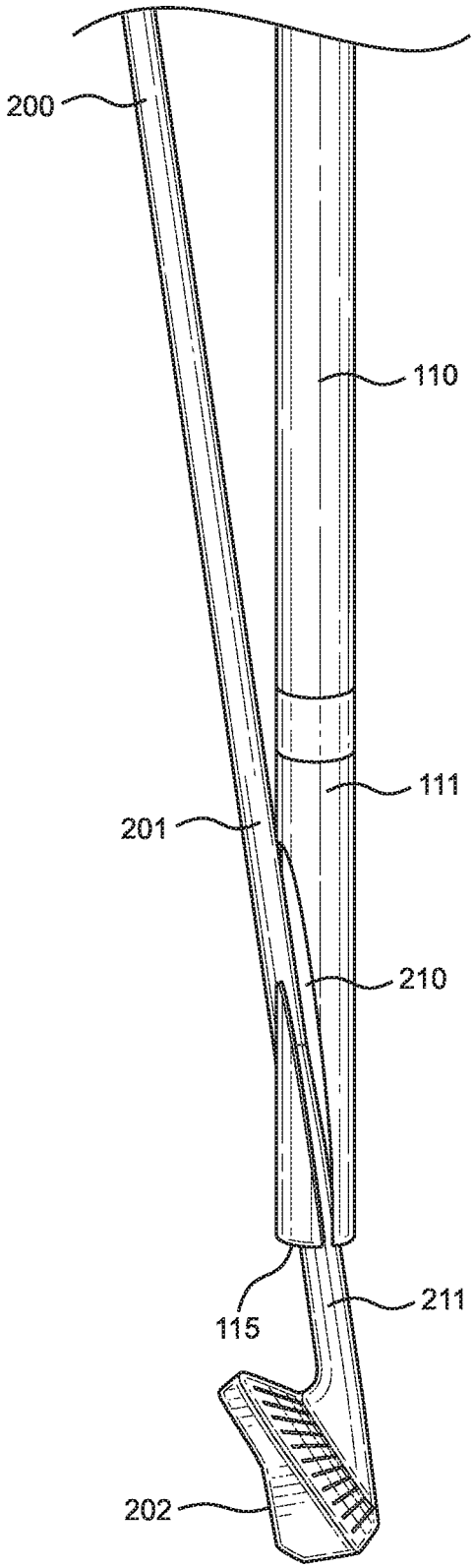
FIG. 2 shows a side view of an embodiment of the golf swing training device, with a focus on a slot in use.
Figure 4:
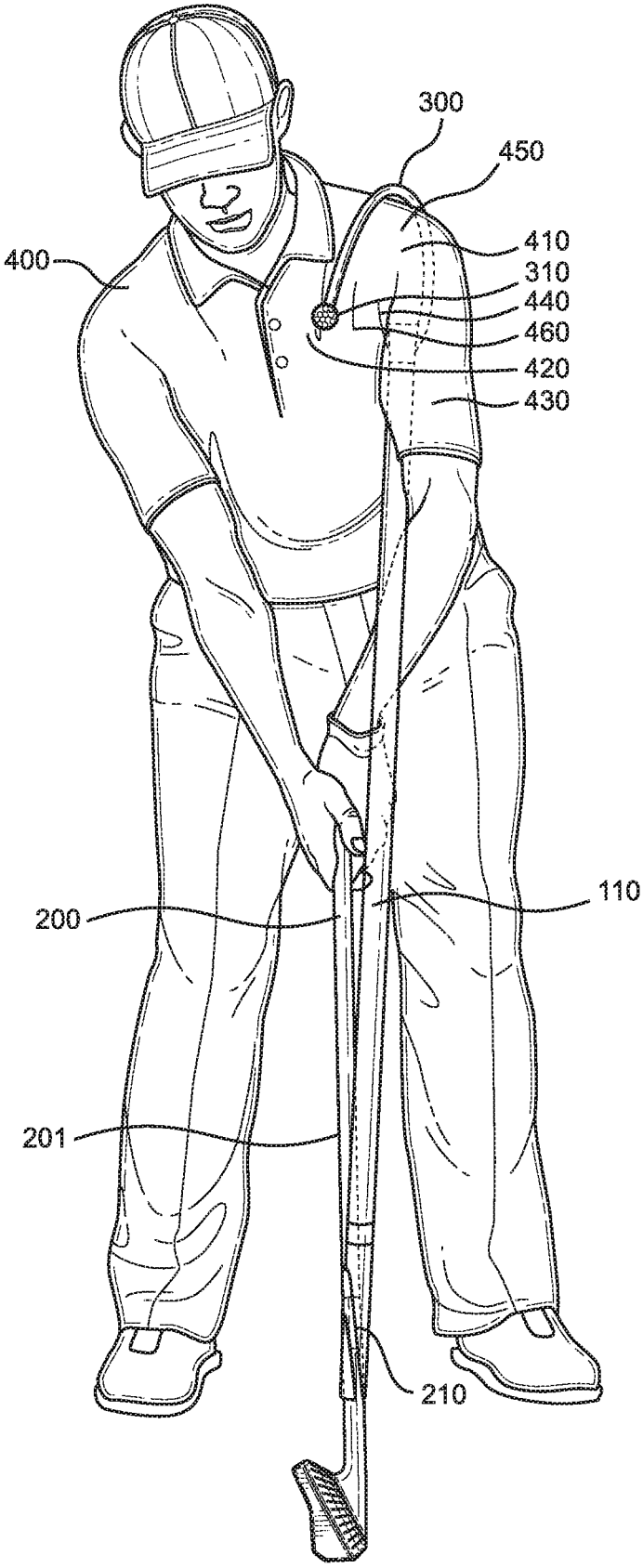
FIG. 4 shows a side perspective view of an embodiment of the golf swing training device, in use.

Referring now to FIG. 2, there is shown a side view of an embodiment of the golf swing training device, with a focus on a slot in use. The first end 111 of the elongated member 110 includes a slot 210, wherein the slot 210 is configured to receive the shaft 201 of the golf club 200. In one embodiment, the elongated member 110 is sized to extend from a lower portion 211 of a shaft 201 of a golf club 200 up to the user's shoulder height. In another embodiment, the elongated member 110 is sized to extend from a lower portion 211 of the shaft 201 of the golf club 200 up to a rear surface of the user's shoulder. In an alternate embodiment, a length of the elongated member 110 is sized to extend from a lower portion 211 of the shaft 201 of the golf club 200, when said shaft 201 is received by the slot 210, to a top surface of the user's shoulder (as shown in FIG. 4, below). In the shown embodiment, the slot 210 passes through a distal end 115 of the first end 111 of the elongated member 110. Therefore, it is contemplated that the elongated member 110 and the present device overall can be sized to accommodate various heights of golfers.

The slot 210 is disposed at a diagonal angle relative to the elongated member 110 such that the shaft 201 of the golf club 200 passes through the elongated member 110. In various embodiments, whereupon the shaft 201 of the golf club 200 is received in the slot 210, the angle of a golf club 200 head 202 relative to a ground surface is a desired angle. One of ordinary skill in the art will understand that each type of golf club, from woods to irons to wedges, each have a desired angle at which the golf club 200 shaft 201 must lie in order to present the golf club 200 head 202 at the angle desired to optimally strike a golf ball. Therefore, it is contemplated by the present disclosure that in various embodiments, the angle of the slot 210 relative to the elongated member 110 will change based on factors such as the type of golf club being utilized and the height of the user.

Figure 3A:
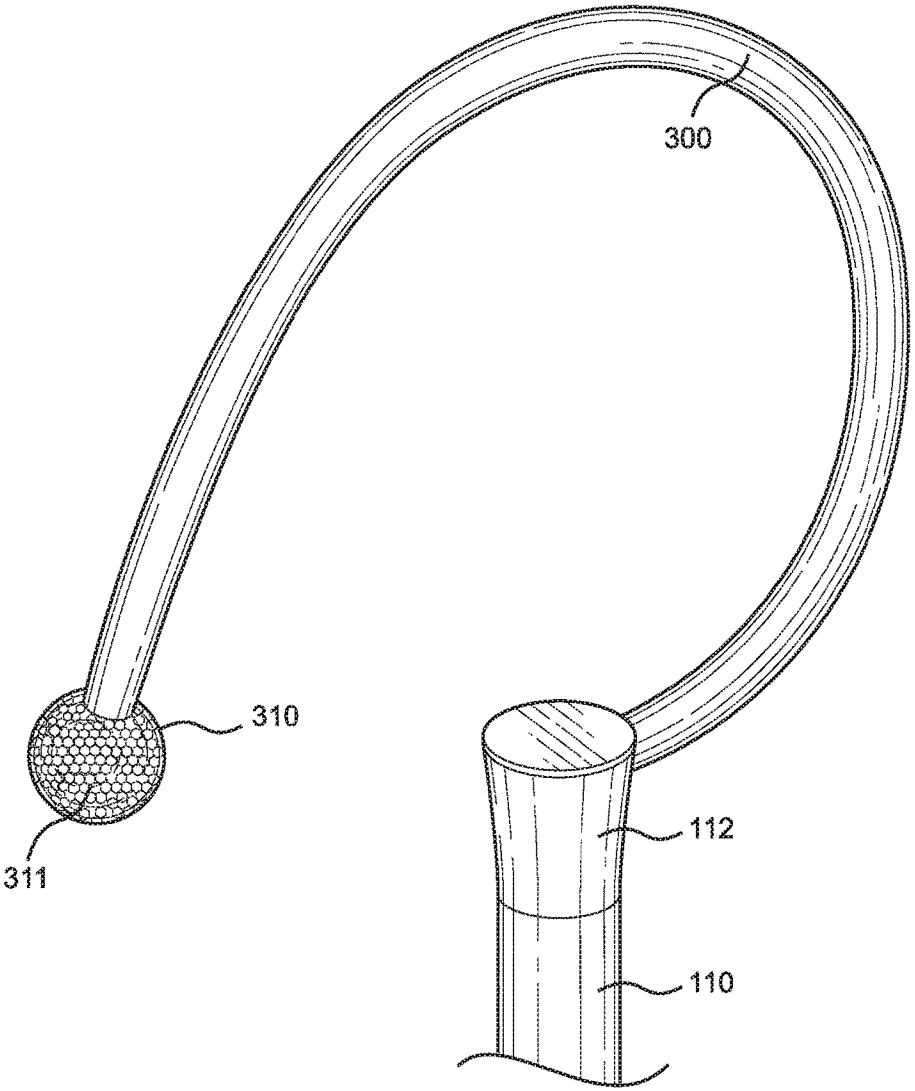
FIG. 3A shows a side view of an embodiment of the golf swing training device, with a focus on a curled member.

Referring now to FIG. 3A, there is shown a side view of an embodiment of the golf swing training device, with a focus on a curled member. A curled member 300 is disposed on the second end 112 of the elongated member 110 and the curled member 300 is configured to wrap around a shoulder of a user (as shown in FIG. 4, below.) In one embodiment, the curled member 300 is a copper tubing to provide a strong and durable material. In some embodiments, the curled member 300 includes a contour that is sized and shaped to mimic and accommodate the contours of the shoulder of the user. In one embodiment, the curled member 300 is specifically configured to wrap behind the shoulder of the user, wrap over a top surface of the shoulder, and terminate on a front surface of the shoulder when the device is worn. As such, the contours, angles, and sizes of the curled member vary from one embodiment to another in order to accommodate different body types, shapes, and sizes of the user, as shown in FIG. 1.

In some embodiments, the curled member 300 includes a rounded distal end 310. In further embodiments, the curled member 300 is configured to wrap around the shoulder of the user such that the rounded distal end 310 rests against a center of the user's chest (as shown in FIG. 4.) The rounded distal end 310 is configured to provide tactile feedback to the user as the user progresses through a golf backswing and golf swing. As the user progresses through their golf swings, the feeling of the rounded distal end 310 rotating against the center of their chest provides positive feedback that the proper mechanics and form of golf swings are being utilized. Where the user fails to feel the rounded distal end 310 at any portion of their golf swing, they are made aware that their mechanics and form are deviating from the desired mechanics and form. In the shown embodiment, the rounded distal end 310 is comprised of an exterior portion of a golf ball. In such an embodiment, the rounded distal end 310 includes a plurality of dimples 311. The dimples 311 provide added surface area and enable a user to better feel the presence of the rounded distal end 310 as it rotates against the center of the user's chest while the user goes through the motions of a golf swing.

Figure 3B:
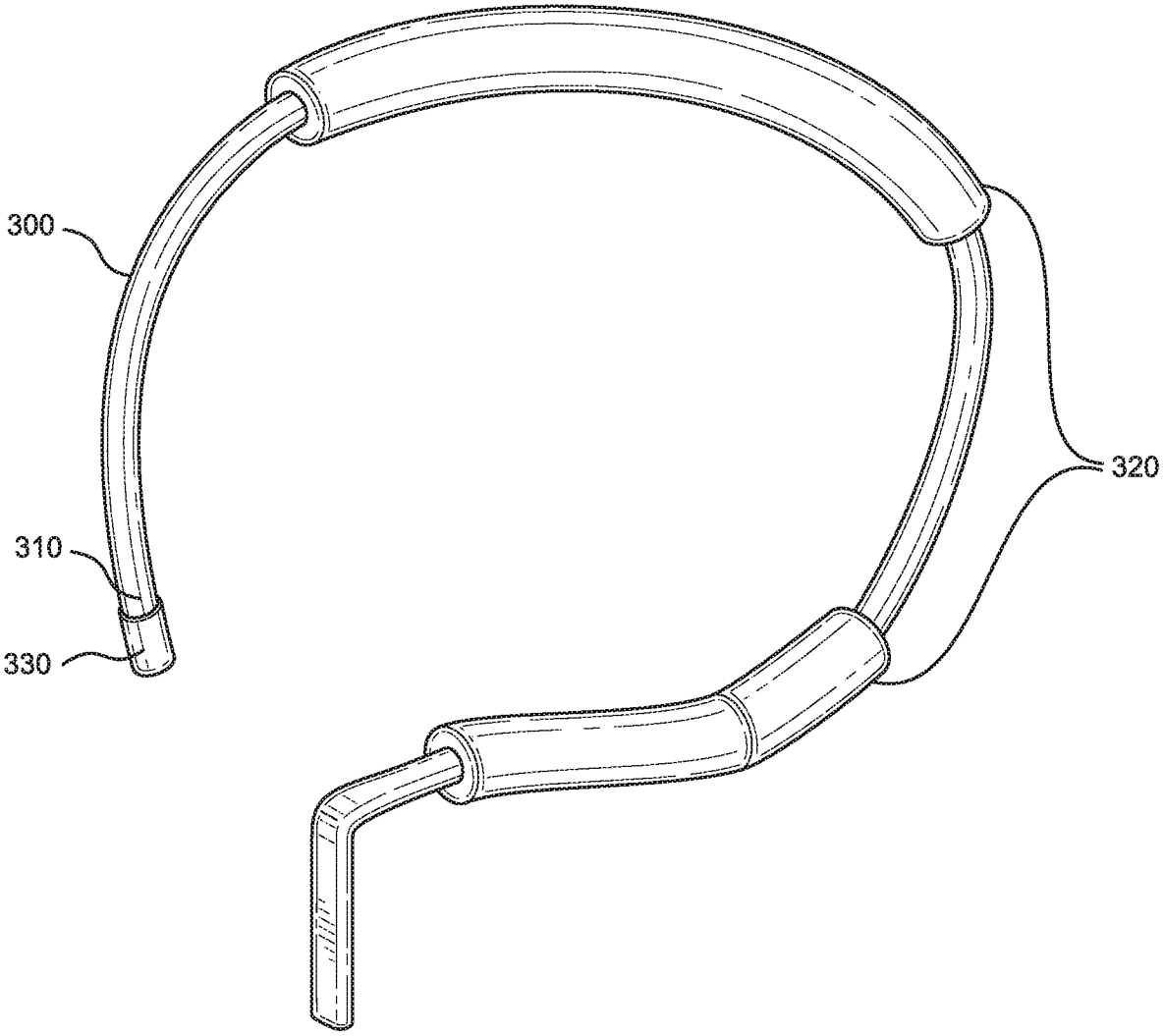
FIG. 3B shows a side view of an alternate embodiment of the golf swing training device, with a focus on a curled member.
Figure 3C:
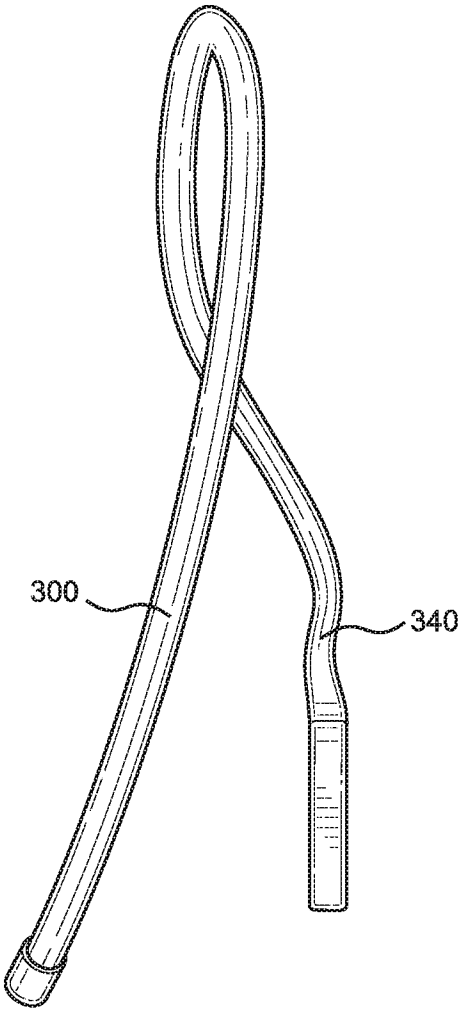
FIG. 3C shows a side view of an alternate embodiment of the golf swing training device, with a focus on a curled member.
Figure 6A:
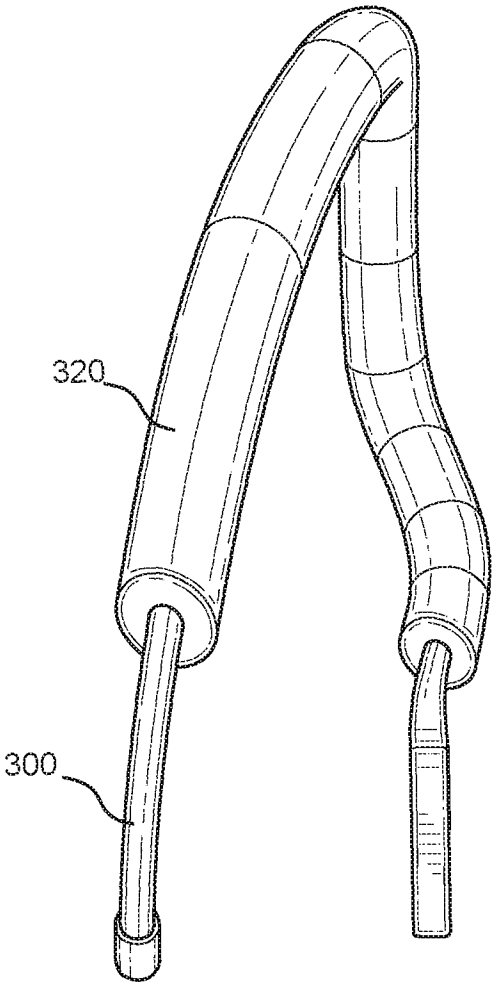
FIG. 6A shows a perspective view of an embodiment of the golf swing training device having additional padding.
Figure 6B:
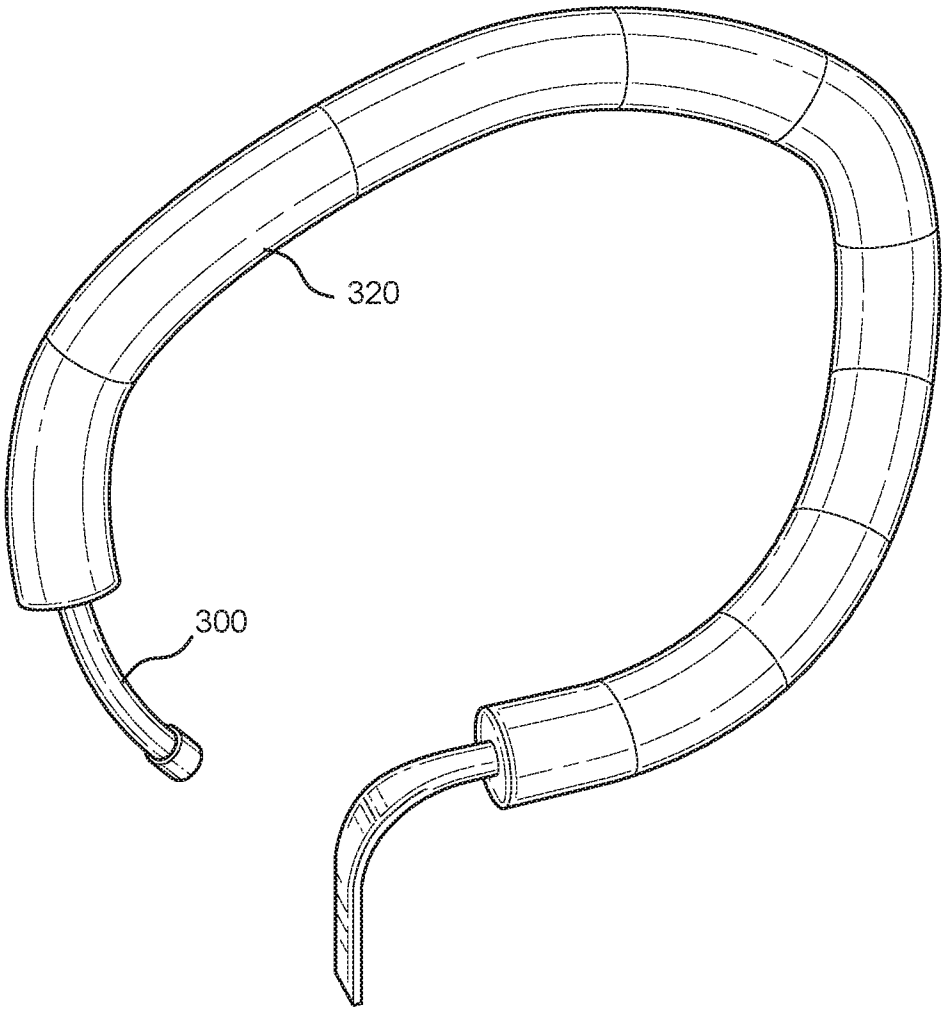
FIG. 6B shows an alternate perspective view of an embodiment of the golf swing training device having additional padding.

Referring now to FIG. 3B, there is shown a side view of an alternate embodiment of the golf swing training device, with a focus on a curled member. In the shown embodiment, a padded material 320 is disposed along lengths of the curled member 300 that may come into contact with a user's body when the device is worn and in use. In the shown embodiment, the padded material 320 covers not just the initial point of contact with the user's shoulder, but also extends along a length of the curled member 300 such that as the device is rotated and used, any points of the curled member 300 that may come into contact with the shoulder, arm, chest, or similar parts of the user are covered. The padded material 320 can include separate sections that are slidable along the curled member 300 for adjustability. In another embodiment, as shown in FIGS. 6A and 6B, the padded material 320 can be a unitary element that extends along the length of the curled member 300. Additionally, in the shown embodiment, the rounded distal end 310 of the curled member 300 comprises a cushioning material 330. Both the cushioning material 330 and the padded material 320 enable the device to be used while provided maximal comfort to the user.

Referring now to FIG. 3B, there is shown a side view of an alternate embodiment of the golf swing training device, with a focus on a curled member. It is contemplated that each individual user's body shape and type may vary. For example, the embodiment shown in FIG. 3A depicts a curled member 300 that has a wide diameter to accommodate the distance between a front and a back of the individual's torso. Similarly, it is contemplated that each individual has varying contours of their arms, shoulders, torso, and the like. The present device can be tailored to mimic the contours to provide maximal comfort to the user. In the shown embodiment, a depression 340 is disposed along a length of the curled member 300 corresponding to where the individual's arm would reside when the device is in use. In the preferred embodiment, the depression 340 mimics the contours of the individual user's arms and torso such that the curled member 300 can maintain contact with the individual as they perform a golf swing. It is contemplated by the present disclosure that the depression 340 can vary according to the various sizes, shapes, and contours of individual users and it will be understood by one of ordinary skill in the art that the fitting of the curled member 300 to the individual can be custom fit.

Referring now to FIG. 4, there is shown a side perspective view of an embodiment of the golf swing training device, in use. The golf swing training device can be used to provide tactile feedback to a wearer 400 by placing a shaft 201 of a golf club 200 through a slot 210 in an elongated member 110 and placing a curled member 300 disposed on a second end of the elongated member 110 over a wearer's shoulder 410. In the shown embodiment, the curled member 300 is configured to wrap around the shoulder 410 of the wearer such that the rounded distal end 310 rests against a center of the wearer's chest 420. In the shown embodiment, the elongated member 110 is configured to be held between an arm 430 of the wearer and a side 440 of the wearer. Further, in the shown embodiment, the curled member 300 is configured to wrap behind the shoulder 410 of the wearer 400, wrap over a top surface 450 of the shoulder 410, and terminate on a front surface 460 of the shoulder 410 when the device is worn.

Figure 5:
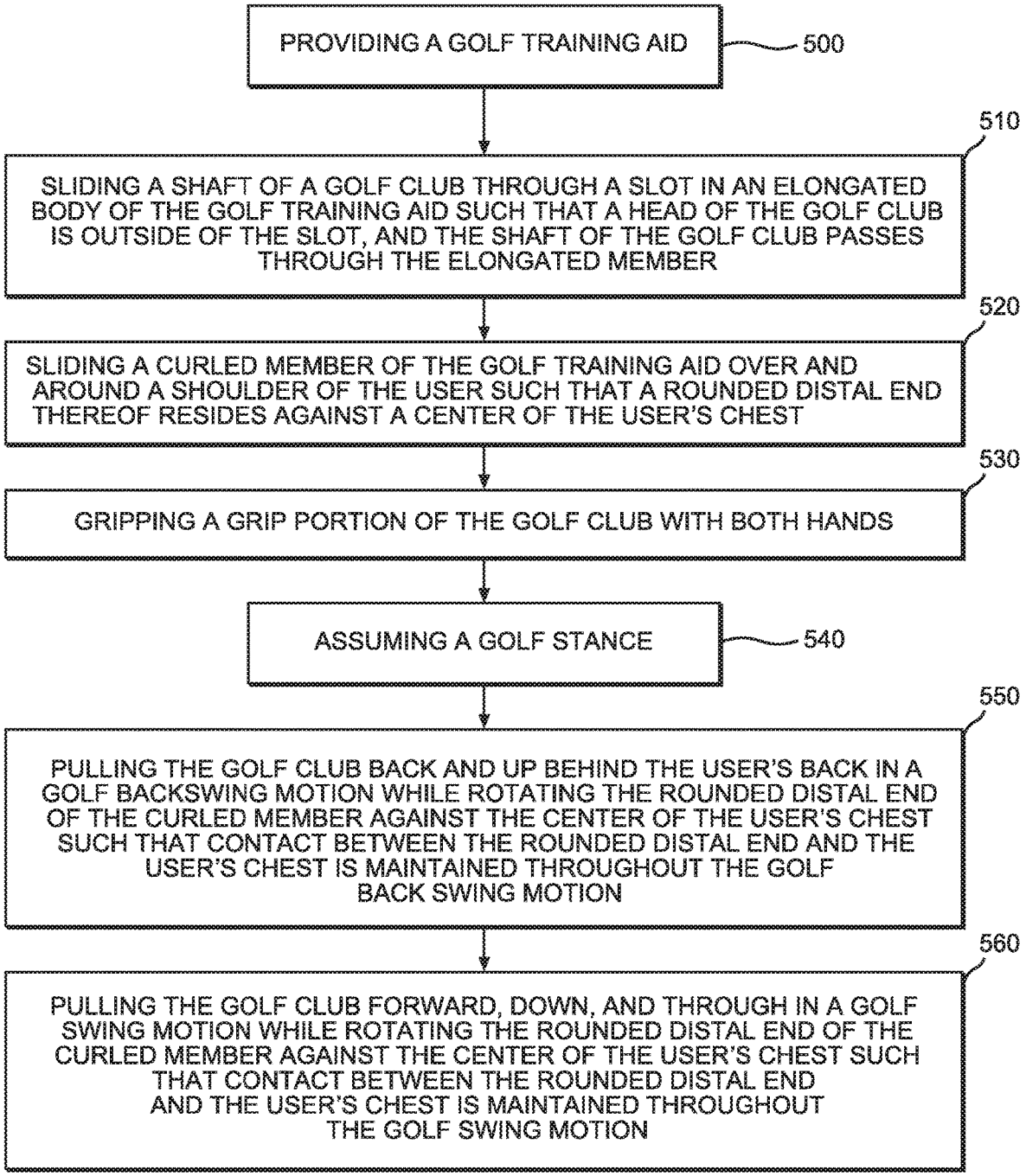
FIG. 5 shows a chart illustrating the use of an embodiment of the golf swing training device.

Referring now to FIG. 5, there is shown a chart illustrating the use of an embodiment of the golf swing training device. A method of using a golf swing training device, comprises the following series of steps. First, a user is provided with a golf training aid 500. Next, the user can slide a shaft of a golf club through a slot in an elongated body of the golf training aid such that a head of the golf club is outside of the slot, and the shaft of the golf club passes through the elongated member 510. Next, the user can slide a curled member of the golf training aid over and around a shoulder of the user such that a rounded distal end thereof resides against a center of the user's chest 520. Then, a user can grip a grip portion of the golf club with both hands 530. The user then assumes a golf stance 540 and pulls the golf club back and up behind the user's back in a golf backswing motion while rotating the rounded distal end of the curled member against the center of the user's chest such that contact between the rounded distal end and the user's chest is maintained throughout the golf back swing motion 550. In the preferred embodiment, at the top of the golf swing, the rounded distal end of the curled member touches the bottom of the user's chin, slightly. Next, the user can begin a forward golf swing by pulling the golf club forward, down, and through in a golf swing motion while rotating the rounded distal end of the curled member against the center of the user's chest such that contact between the rounded distal end and the user's chest is maintained throughout the golf swing motion 560. In this manner, the golf swing training device can be utilized to provide tactile feedback to a user as they execute a golf swing and aids in training the user to keep their arms in a proper position throughout a backswing and a golf swing motion.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf swing training device, comprising:

an elongated member with a first end disposed opposite a second end;

the first end includes a slot, wherein the slot is configured to receive a shaft of a golf club;

the slot is disposed at a diagonal angle relative to the elongated member such that the shaft of the golf club passes through the elongated member;

a curled member is disposed on the second end; and the curled member is configured to wrap around a shoulder of a user.

2. The golf swing training device of claim 1, wherein the curled member includes a rounded distal end.

3. The golf swing training device of claim 2, wherein the rounded distal end is comprised of an exterior portion of a golf ball.

4. The golf swing training device of claim 2, wherein the curled member is configured to wrap around the shoulder of the user such that the rounded distal end rests against a center of the user's chest.

5. The golf swing training device of claim 1, wherein the elongated member has a one-inch diameter.

6. The golf swing training device of claim 1, wherein the elongated member is composed of polyvinyl chloride (PVC).

7. The golf swing training device of claim 1, whereupon the shaft of the golf club is received in the slot, the angle of a golf club head relative to a ground surface is a desired angle.

8. The golf swing training device of claim 1, wherein a length of the elongated member is sized to extend from a lower portion of the shaft of the golf club, when said shaft is received by the slot, to a top surface of the user's shoulder.

9. The golf swing training device of claim 1, wherein the curled member is a copper tubing.

10. The golf swing training device of claim 1, wherein the slot passes through a distal end of the first end.

11. A method of using a golf swing training device, comprising the steps of:

providing a golf training aid;

sliding a shaft of a golf club through a slot in an elongated body of the golf training aid such that a head of the golf club is outside of the slot, and the shaft of the golf club passes through the elongated member;

sliding a curled member of the golf training aid over and around a shoulder of the user such that a rounded distal end thereof resides against a center of the user's chest;

gripping a grip portion of the golf club with both hands;

assuming a golf stance;

pulling the golf club back and up behind the user's back in a golf backswing motion while rotating the rounded distal end of the curled member against the center of the user's chest such that contact between the rounded distal end and the user's chest is maintained throughout the golf back swing motion; and pulling the golf club forward, down, and through in a golf swing motion while rotating the rounded distal end of the curled member against the center of the user's chest such that contact between the rounded distal end and the user's chest is maintained throughout the golf swing motion.

* * * * *